United States Patent [19]

Junghans

[11] Patent Number: 5,003,874

[45] Date of Patent: Apr. 2, 1991

[54] DISTRIBUTOR ROLLER FOR AN INKING UNIT OF A PRINTING PRESS

[75] Inventor: Rudi Junghans, Wilhelmsfeld, Fed. Rep. of Germany

[73] Assignee: Heidelberger Druckmaschinen, Heidelberg, Fed. Rep. of Germany

[21] Appl. No.: 445,481

[22] Filed: Dec. 4, 1989

[30] Foreign Application Priority Data

Dec. 3, 1988 [DE] Fed. Rep. of Germany ..... 3840871

[51] Int. Cl.[5] ..... B41F 31/14; B41F 31/26; B41L 27/16

[52] U.S. Cl. ..... 101/348; 101/DIG. 38

[58] Field of Search ..... 101/349, 350, 148, DIG. 38, 101/348, 205, 206, 207, 208, 354, 353, 359, 360–362

[56] References Cited

U.S. PATENT DOCUMENTS

| | | | |
|---|---|---|---|
| 897,152 | 8/1908 | Rockstroh | 101/DIG. 38 |
| 3,118,373 | 1/1964 | Masemiller | 101/348 |
| 3,978,788 | 9/1976 | Cappel et al. | 101/363 |
| 4,280,583 | 7/1981 | Steig | 180/250 |
| 4,428,290 | 1/1984 | Junghans et al. | 101/348 |
| 4,680,992 | 7/1987 | Hayasaki et al. | 74/869 |
| 4,711,172 | 12/1987 | Capdebosc | 101/152 |
| 4,743,776 | 5/1988 | Baehler | 290/31 |
| 4,856,369 | 8/1989 | Stockton | 74/665 |

FOREIGN PATENT DOCUMENTS 2238481 8/1972 Fed. Rep. of Germany .

*Primary Examiner*—J. Reed Fisher

*Attorney, Agent, or Firm*—Nils H. Ljungman & Associates

[57] ABSTRACT

A distributor roller for use in a printing press which includes an axial shaft member, a casing member surrounding the axial shaft member and being rotatably and axially slidably mounted with respect thereto, an interior surface of the casing member having a cross-section which, when taken tranverse to the axial shaft member, is eccentrically disposed with respect thereto, an arrangement for rotating the casing member about the axial shaft member, an oscillating body member disposed within the casing member and mounted for pivotal movement in a direction transverse to the longitudinal axial shaft member, the oscillating body member having an engagement surface for engaging the eccentrically disposed interior surface of the casing member, thereby the oscillating body member is caused to undergo a reciprocating movement in the direction transverse to the axial shaft member upon rotation of the casing member thereabout, and conversion means for converting the reciprocating movement of the oscillating body member into a reciprocating axial displacement of the casing member with respect to the axial shaft member.

20 Claims, 5 Drawing Sheets

DISTRIBUTOR ROLLER FOR AN INKING UNIT OF A PRINTING PRESS

BACKGROUND OF THE INVENTION

1. Field of the Invention:

The present invention relates to a distributor roller for an inking unit of a printing press, and includes a roller axis which is mounted in bearings so as to be fixed against rotation, and a roller casing which is rotatably mounted on the roller axis and is driven such that, via drive means provided within the roller casing, the rotating roller casing is caused to reciprocate axially.

2. Description of the Prior Art:

German Offenlegungsschrift (German Laid Open Patent Application) No. 22 38 481 describes a printing press drive having a distributor roller which can execute rotating and reciprocating movements simultaneously. In this publication, a planetary gear serves as a drive means which, in connection with a cam, causes the roller casing to execute an axial stroke. The described reduction gear yields a maximum gear reduction ratio of 1:4, so that four revolutions of the distributor roller perform a stroke of, for example, 15 mm. However, it has been found that, with highly efficient printing machines, which complete on the order of 40,000 plate cylinder revolutions per hour, such a distributor roller performs on the order of 1,850 revolutions per minute in the inking unit. This results in 460 stroke movements in one minute and 7.5 stroke movements in one second. Such a high-frequency roller motion can cause considerable wear and tear in the drive means and can also generate additional vibration forces which may have detrimental effects on the quality of the printing. In view of the given mass of such a distributor roller, the machine side frame may also be subjected to considerable impact forces.

OBJECT OF THE INVENTION

One object of the present invention is the provision of a drive means for such a roller which allows a considerably greater gear reduction ratio to be achieved, so that the axial stroke of the distributor roller does not bring about an impact-like reversal of motion, even at relatively high speeds.

Another object of the present invention is the provision of an axial drive means in which the motion of the distributor roller in the axial direction is smoothly decelerated.

SUMMARY OF THE INVENTION

According to the invention, these and other objects are achieved by providing, as drive means, an oscillating body which, being eccentrically driven by the roller casing, executes an oscillating movement transversely to the longitudinal axis of the distributor roller. The oscillating movement is thereafter transmitted, in the form of a rotary movement and via an overrun clutch, onto a cam, which axially displaces the roller casing by means of its rotary movement. Preferably, the drive means for the axial motion achieves a sufficient gear reduction to cause a stroke movement of the distributor roller once every 31.4 revolutions. This corresponds to approximately one distributing movement per second at a machine speed of 40,000 cylinder revolutions per hour, so that the drive forces and, thus the wear, are greatly reduced and transmit relatively few vibrations to the supporting machine parts. With the present invention, it is, furthermore, possible to use relatively sturdy structural members, so that a reliable operation is guaranteed. Moreover, the vibration-free effect increases the printing precision.

In a particularly advantageous embodiment of the invention, the oscillating body is mounted so as to oscillate on a bearing pin which is disposed in a non-rotating bearing body. The non-rotating bearing body is, in turn, fastened on the roller axis. The oscillating body carries two diametrically opposed ball bearings, the axes of which extend parallel to the roller axis. The ball bearings engage a roll-off surface to thereby act as an eccentric. The roll-off surface is provided in the interior of by a roller casing and to eccentrically disposed with respect to the roller axis and the roll-off surface rotates together with said roller casing. The roll-off surface transmits an oscillating movement onto the oscillating body. The oscillating movement is transmitted from the oscillating body, via a connection pin, onto a rotary body, which is rotatably mounted on the roller axis and which cooperates with a provided overrun clutch, such that the pulse-like rotary movements generated in one direction of rotation drive a cam, which is mounted on the roller axis so as to be fixed against axial translation. Cam rollers are provided for transmitting the stroke onto the roller casing via a bearing body and a ball bearing.

One aspect of the invention resides broadly in a distributor roller for use in a printing press which includes an axial shaft member having a longitudinal axis and a casing member which substantially encircles the axial shaft member and which is rotatably and axially slideably mounted for rotation about and for axial translation with respect to the axial shaft member. The casing member has an interior surface which substantially surrounds the axial shaft member and the cross-section of which, when taken substantially transverse to the axial shaft member, is eccentrically disposed with respect to the shaft member. A drive arrangement is provided for rotating the casing member about the axial shaft member. The oscillating body member is disposed within the casing member and is pivotally mounted for pivotal movement in a direction substantially transverse to the longitudinal axis of the axial shaft member. The oscillating body member has at least one engagement surface for engaging the eccentrically disposed interior surface of the casing member, whereby the oscillating body member is caused to undergo a reciprocating movement in the direction substantially transverse to the longitudinal axis of the axial shaft member upon rotation of the casing member about the axial shaft member. A conversion apparatus is provided for converting the reciprocating movement of the oscillating body member into a reciprocating axial displacement of the casing member with respect to the axial shaft member.

BRIEF DESCRIPTION OF THE DRAWINGS

We turn now to a detailed description of a preferred embodiment of the invention, after first describing the drawings, wherein.

DESCRIPTION OF THE PREFERRED EMBODIMENT

Figure 1:
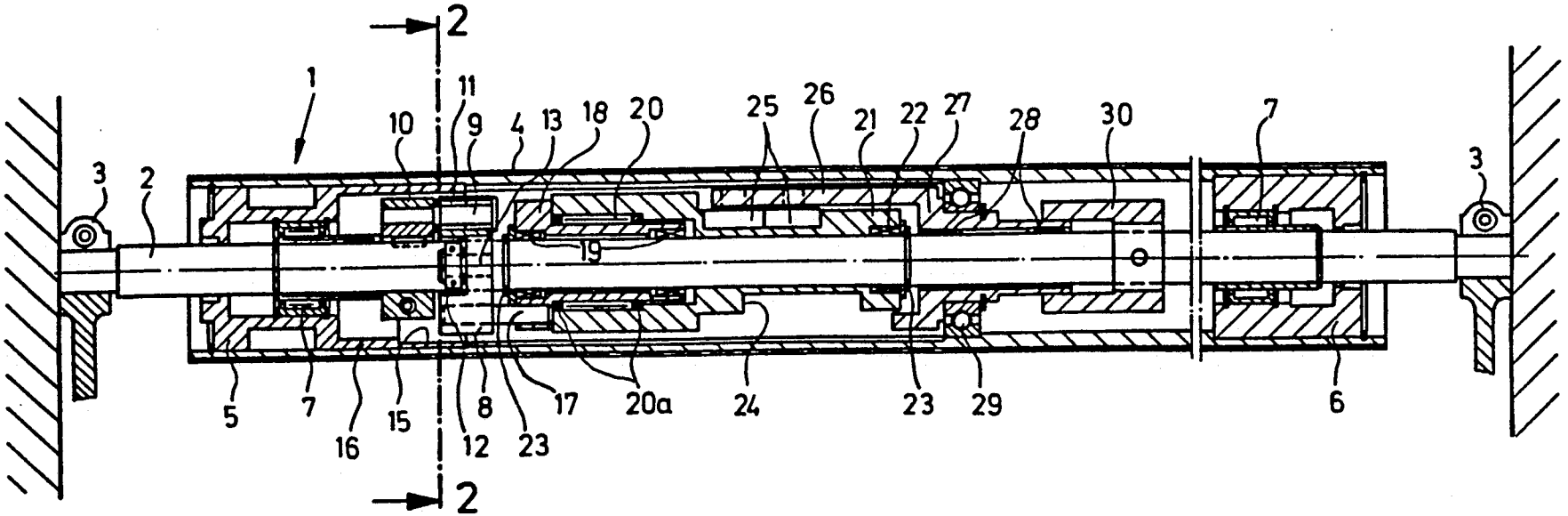
FIG. 1 is a longitudinal section through an oscillating distributor roller constructed according to the invention.

As shown in FIG. 1, a distributor roller 1 is mounted on a roller axis 2. The roller axis 2 is non-rotatably mounted in bearings 3, so as to be fixed against rotation. The bearings 3 may, for example, be mounted on a machine side frame, as shown schematically. Via bearings 5 and 6 and needle bearings 7, a roller casing 4 of the distributor roller 1 is mounted on the roller axis 2 so as to be both rotatably and longitudinally displaceable with respect thereto. In the preferred embodiment shown, the roller casing 4 is preferably friction-driven by a rotatably driven neighboring roller or cylinder.

Figure 2:
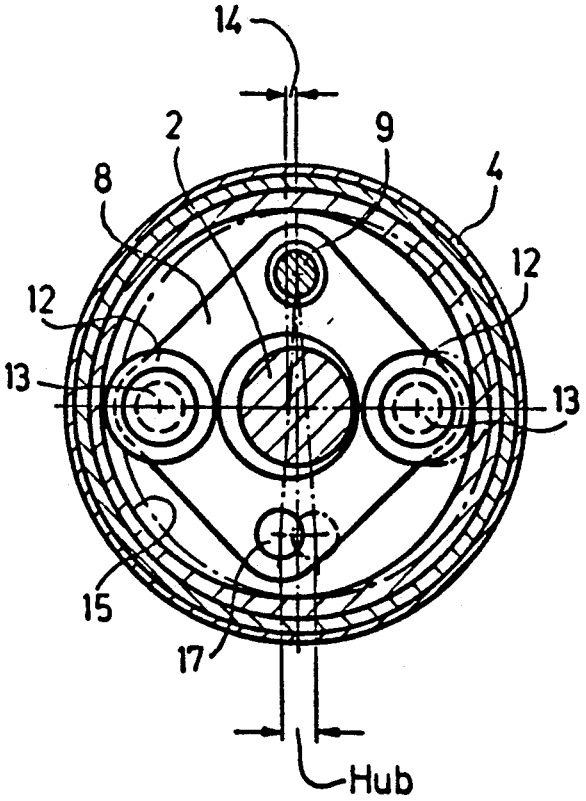
FIG. 2 is a cross-section through the oscillating distributor roller of FIG. 1 along the line 2—2.
Figure 3:
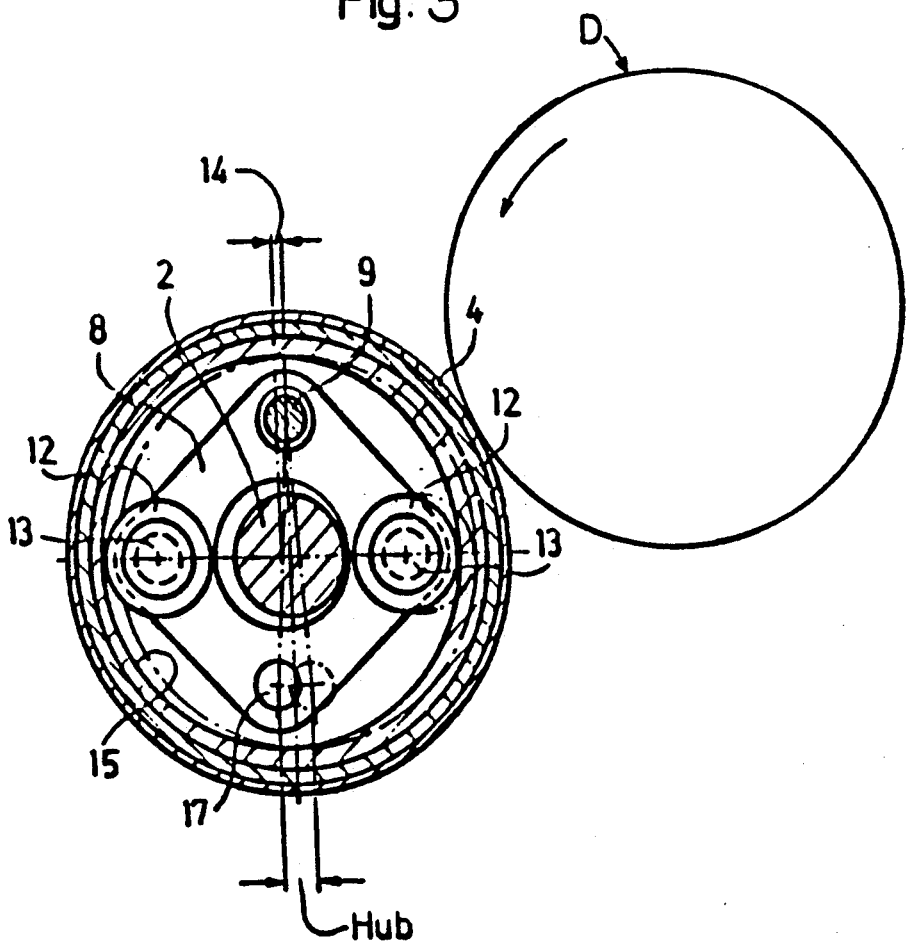
FIG. 3 is substantially similar to FIG. 2 but shows a driving roller D for driving the oscillating distributor roller of the present invention.

An oscillating body 8 (shown in frontal view in FIG. 2), which is rotatably mounted on a bearing pin 9 so as to oscillate, is provided within the roller casing 4 as drive means for the axial stroke of the roller casing 4. The bearing pin 9 is mounted on a non-rotating bearing body 10, which is fixedly attached to the roller axis 2. For example, non-rotating bearing body 10 may be clamped on the roller axis 2. In the preferred embodiment shown, the oscillating body 8 is mounted via a needle bearing 11 on the bearing pin 9. Via pins 13, two diametrically opposed ball bearings 12 the axes of which are disposed parallel to the roller axis 2, are mounted on the oscillating body 8. The two ball bearings 12 rollingly contact a roll-off surface 15, which is provided within the interior of the roller casing 4 and which is disposed eccentrically with respect to the roller axis 2. The eccentricity of the roll-off surface 15 with respect to the roller axis 2 provides a degree of eccentricity 14, when the oscillating body 8 is positioned at either of the two extremes of its range of movement. As shown, and preferably, the roll-off surface 15 is provided on the interior of an annular flange extension 16 of the bearing 5 to thereby rotate together with the roller casing 4. If the eccentricity of the roll-off surface 15 amounts to, for example 1 mm, the oscillating movement of the oscillating body 8 will amount to 2 mm, as shown in FIG. 2. In such case, the two ball bearings 12 ride on the roll-off surface 15 with very little play and thereby reciprocate the oscillating body 8 so as to oscillate about the bearing pin 9.

On the oscillating body 8, there is mounted, opposite the bearing pin 9, a connection pin 17 which extends into a rotary body 18 rotatably mounted on the roller axis 2. The rotary body 18 is rotatably mounted via needle bearings 19 and is secured against any substantial axial movement. On the rotary body 18, there is provided an overrun clutch 20, designed as a sleeve-type overrun clutch, which features rolling bearings 20*a* on both sides thereof and which transmits the rotary movement of rotary body 18 in only one direction. Thus, the rotation of the roller casing 4 causes a pendulum like oscillating motion of oscillating body 8, which is transmitted by the connection pin 17 to the rotary body 18. The motion of rotary body 18 is then transferred pulse-like to a cam 21 through the overrun clutch 20. The cam 21 is also rotatably mounted on the roller axis 2 via needle bearings 22. The rotary body 18 and the cam 21 are both substantially axially stabilized by means of retaining rings 23. The cam track 24 is preferably designed as a sine curva having a stroke of, for example, 15 mm. Two cam rollers (or cam followers) 25, which are driven in an axial direction as a result of the cammed surface, move in a cam track 24.

In other words, the pendulum-like reciprocating movement of the oscillating body 8 is transferred, via connecting pin 17, to the rotary body 18, which is thereby imparted with a reciprocating rotational movement. The overrun clutch 20 effectively converts this reciprocating rotational motion into a one directional rotational movement, whereby cam 21 is caused to undergo a one directional pulse-like rotational advancement. Cam 21 is provided with an axial camming surface 24, which is preferably in the shape of a sinusoidal shape. The two cam followers 25 ride on the axial camming surface 24, and are thereby caused to execute a reciprocating axial sinusoidal motion, as the cam 21 revolves about the axis 2.

Overrun clutches are well known in the art and are described, for example, in U.S. Pat. No. 4,680,992, issued July 21, 1987 and entitled "Downshift Timing And Engine Break Control For Automatic Transmission"; U.S. Pat. No. 4,280,583, issued July 28, 1981 and entitled "Automatic Differential Control Apparatus"; U.S. Pat. No. 4,856,369, issued Aug. 15, 1989 and entitled "Continually Variably Transmission Having Torque Regeneration Operating Mode"; and U.S. Pat. No. 4,743,776, issued May 10, 1988 and entitled "Starter-Generator For Engines". In the present invention, the overrun clutch 20 serves to effectively convert a bidirectional reciprocating rotational motion into a unidirectional rotational motion. Alternatively, a pawl and rachet arrangement probably could be employed to the same end.

The two cam rollers 25 are fastened to the arm 26 of a bearing body 27 which is, in turn, mounted, via bushing 28, on the roller axis 2 so as to be longitudinally displacable with respect thereto. Between the bearing body 27 and the roller casing 4, there is provided a ball bearing 29, which transmits the reciprocating axial motion of the bearing body 27 to the roller casing 4. The bearing body 27 is fixed against rotation with respect to the roller axis 2 by means of a fork-shaped piece 30, which, however, permits an axial motion of the bearing body 27 with respect to the roller axis 2.

Due to the accentric configuration of the roll-off surface 15 with respect to the roller axis 2, the oscillating body 8 is set into sinusoidal swinging motion by, in a preferred embodiment, about 2 mm, and thus a rotary movement is transmitted to the rotary body 18 very slowly and in a relatively impact-free way. Due to the fact that the cam track 24 is preferably designed sinusoidally, the further transmission of motion onto the roller casing 4 is substantially impact-free, whereby the roller casing 4 is caused to execute a very smooth reciprocating motion. The eccentricity of the roll-off surface 15 and the stroke of the cam track 24 can, of course, be adjusted to any particular requirements which circumstances may dictate.

Figure 4:
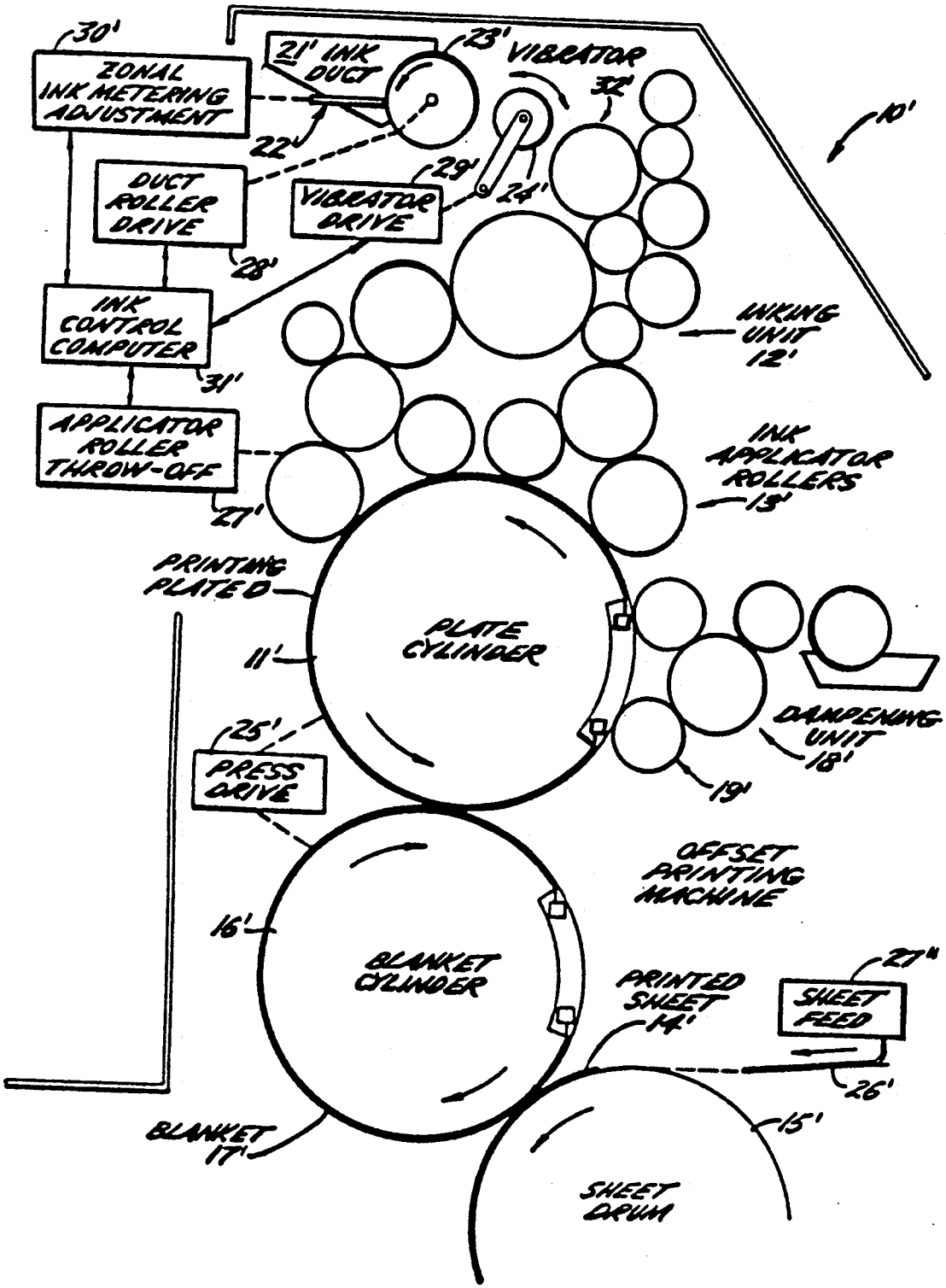
Fig. 4 PRIOR ART
FIG. 4 is an elevational illustrational view of a prior art printing press.

Referring now to FIG. 4, a rotary print stand 10', well known in the art, generally includes: a plate cylinder 11' having mounted therein a printing plate D; an inking unit 12' which includes ink applicator rollers 13' for applying to printing plate D an ink profile of a single color printing ink (for example, black, cyan, magenta or yellow); a dampening (or wetting) unit 18' having dampening applicator rollers 19' for transferring a dampening agent to printing plate D; a blanket cylinder 16' carrying a rubber blanket 17' for receiving an ink impression from printing plate D; and a sheet drum 15' for carrying a printed sheet 14' onto which the ink impression carried by blanket 17' is transferred.

It is particularly important that the ink be applied to printing plate D in a precisely defined and controllable manner. That is, those areas of printing plate D, having a high density of printed content, will require a greater ink flow during the printing process than those areas having a lower density of printed content. To this end, the printing stand 10' is typically provided with a means for zonally varying the ink application profile across the width of the printing stand 10'. For example, as shown in FIG. 1, printing stand 10' may be provided with an ink duct 21' which extends across its width. The zonal adjustment of the ink application profile is provided by a plurality of ink metering ducts 22' which may be controlled or adjusted by a zonal ink metering adjustment mechanism 30' under the control of a computer 31'.

A duct roller 23' is typically mounted adjacent to ink duct 21'. An ink duct of this type is further described in U.S. Pat. No. 3,978,788, issued Septl 7, 1976, the contents of which are hereby expressly incorporated by reference as if this patent were set forth in its entirety herein.

Typically, the ink application profile, which is set up on duct roller 23', is transferred into the inking unit 12' by means of a vibrator roller 24' which oscillates to successively pick up strips of ink from duct roller 23' and transfer them into inking unit 12', as for example, by contacting one of the rollers 32' thereof. The operation of such a vibrator roller 24' is more fully described in U.S. Pat. No. 3,908,545, issued Sept. 30, 1975, this issued U.S. patent being hereby expressly incorporated by reference as if the contents thereof were set forth fully herein.

Typically, the printing stand 10' will also include auxiliary mechanisms such as, for example: a duct roller drive 28'; a vibrator roller drive 29'; an applicator roller throw-off 27' for lifting the ink applicator rollers 13' off of the printing plate D; a press drive 25' and a sheet feed 27'' for supplying the sheets to be printed 26' to sheet drive drum 15'.

Figure 5:
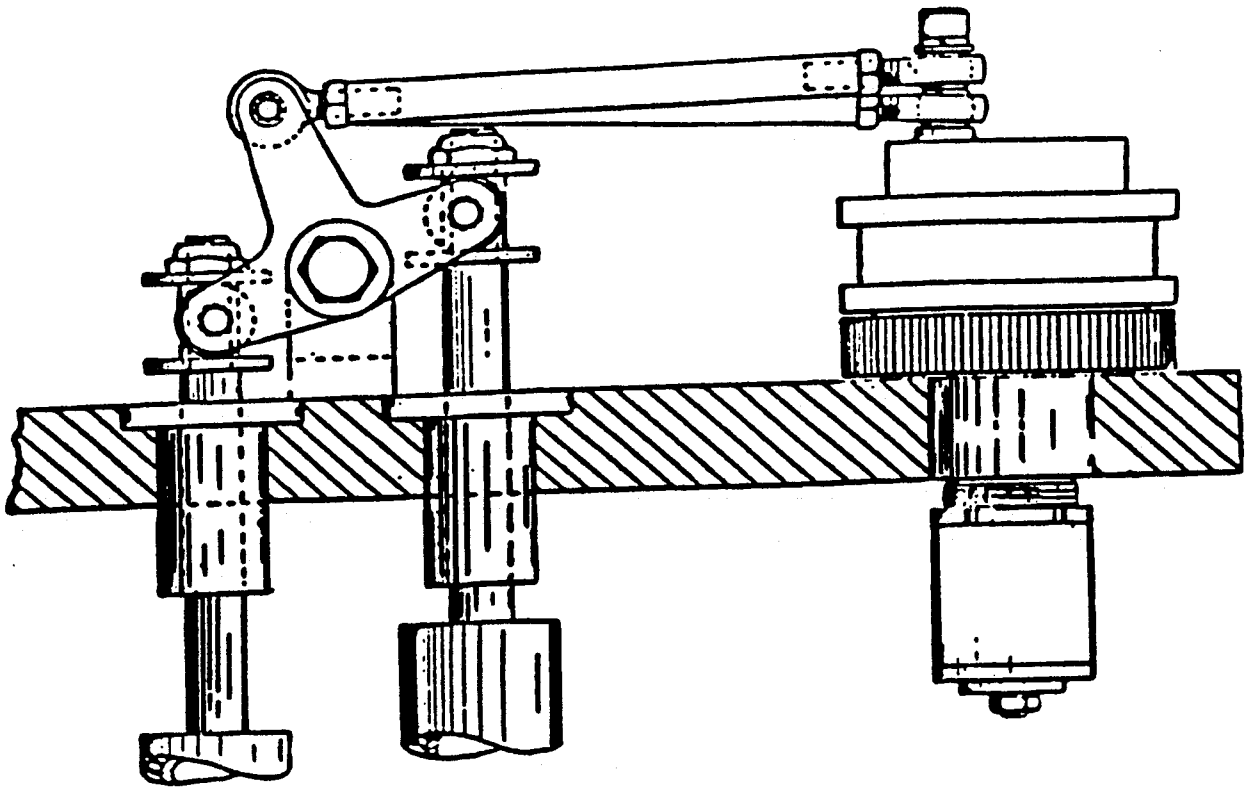
Fig. 5 PRIOR ART
FIG. 5 is a partially sectional elevational view of a prior art oscillating distributor roller mechanism.

FIG. 5 shows a known prior art oscillating distributor roller arrangement, as disclosed in U.S. Pat. No. 3,118,373, issued Jan. 21, 1964 and entitled "Inker", wherein a pair of distributor rollers 2 and 3 are caused to oscillate by a reciprocating pivotal movement of a member 7 about its pivot point 8. A connecting rod 9, attached to a crank 30, drives number 7 in a reciprocating pivotal fashion to thereby effect an alternating and opposite reciprocation of rollers 2 and 3.

Summing up, in general, the invention features a distributor roller for an inking unit of a printing press, which includes a roller axis, which roller axis is mounted in bearings so as to be fixed against rotation, and a roller casing which is rotatably mounted on the roller axis and is driven such that, via drive means provided in the inside formed by the roller casing, an axial stroke is transmitted onto the rotating roller casing. As drive means, there is provided an oscillating body 8 which, via an eccentric 14 driven by the roller casing 4, executes an oscillating movement transversely to the longitudinal axis of the distributor roller 1. Moreover, via an overrun clutch 20, the oscillating movement is thereafter transmitted in the form of a rotary movement onto a cam 21 which axially displaces the roller casing 4 during its rotary movement.

In a preferred embodiment, the oscillating body 8 is mounted oscillatingly on a bearing pin 9 which is provided in a non-rotating bearing body 10 fastened on the roller axis 2. The oscillating body 8 carries two diametrically opposed ball bearings 12, the axes of which run parallel with respect to the roller axis 2, which are engaged at a roll-off surface 15, acting as an eccentric 14, which is provided eccentrically with respect to the roller axis 2 in the inside formed by the roller casing 4 and rotates together with said roller casing, said roll-off surface transmitting an oscillating movement onto the oscillating body 8. The oscillating movement is transmitted from the oscillating body 8, via a connection pin 17, onto a rotary body 18 which is rotatably mounted on the roller axis 2 and cooperates with an overrun clutch 20 such that the pulse-like rotary movements generated in one direction of rotation drive a cam 21 which is mounted on the roller axis 2 so as to be fixed against rotation, by means of an axial stroke, cam rollers 25 being provided in said cam for transmitting the stroke onto the roller casing 4 via a bearing body 27 and a ball bearing 29.

All of the patents, patent applications, and publications recited herein, if any, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A distributor roller for use in a printing press, said distributor roller comprising:

an axial shaft member, said axial shaft member having a longitudinal axis;

a casing member substantially encircling said axial shaft member, said casing member being rotatably and axially slideably mounted for rotation about and for axial translation with respect to said axial shaft member;

said casing member having an interior surface substantially surrounding said axial shaft member, said interior surface of said axial shaft member having a cross-section which, when taken substantially transverse to said axial shaft member, is eccentrically disposed with respect to said shaft member;

means for rotating said casing member about said axial shaft member;

an oscillating body member disposed within said casing member, said oscillating body member being pivotally mounted for pivotal movement in a direction substantially transverse to the longitudinal axis of said axial shaft member;

said oscillating body member having at least one engagement surface for engaging said eccentrically disposed interior surface of said casing member;

whereby said oscillating body member is caused to undergo a reciprocating movement in the direction substantially transverse to the longitudinal axis of said axial shaft member upon rotation of said casing member about said axial shaft member; and conversion means for converting said reciprocating movement of said oscillating body member into a reciprocating axial displacement of said casing member with respect to said axial shaft member.

2. The distributor roller according to claim 1, wherein said conversion means comprises one way clutch means for converting a reciprocating bidirectional rotary motion about said axial shaft member into a unidirectional rotary motion about said axial shaft member and camming means for converting a unidirectional rotary motion about said axial shaft member into a reciprocating motion substantially parallel to the longitudinal axis of said axial shaft member.

3. The distributor roller according to claim 2, further comprising a rotary member rotationally mounted on said axial shaft member, connecting pin means for connecting said oscillating body member and said rotary member and for causing said rotary body to execute a reciprocating rotational movement about said axial shaft member upon the reciprocating transverse movement of said oscillating body member, wherein said camming means comprises a cam member rotationally mounted on said axial shaft member, and wherein said one way clutch means comprises an overrun clutch interposed between said rotary body and said cam member.

4. The distributor roller according to claim 3, wherein said cam member is provided with an axially disposed camming surface.

5. The distributor roller according to claim 4, wherein said camming means additionally comprises at least one cam follower member disposed so as to abut said axially disposed camming surface provided on said cam member.

6. The distributor roller according to claim 5, wherein said conversion means further comprises a casing member drive member interposed between said at least one cam follower member and said casing member.

7. The distributor roller according to claim 6, wherein said casing member drive member comprises a bearing member mounted on and axially displaceable with respect to said axial shaft member and a ball bearing arrangement interposed between said bearing member and said casing member.

8. The distributor roller according to claim 1, wherein said at least one engagement surface provided on said oscillating body member for engaging said eccentrically disposed interior surface of said casing member comprises at least one roller bearing member rotatably mounted on said oscillating body member about an axis substantially parallel to the longitudinal axis of said axial shaft member and rollingly engaging said eccentrically disposed interior surface of said casing member.

9. The distributor roller according to claim 3, wherein said at least one engagement surface provided on said oscillating body member for engaging said eccentrically disposed interior surface of said casing member comprises at least one roller bearing member rotatably mounted on said oscillating body member about an axis substantially parallel to the longitudinal axis of said axial shaft member and rollingly engaging said eccentrically disposed interior surface of said casing member.

10. The distributor roller according to claim 7, wherein said at least one engagement surface provided on said oscillating body member for engaging said eccentrically disposed interior surface of said casing member comprises at least one roller bearing member rotatably mounted on said oscillating body member about an axis substantially parallel to the longitudinal axis of said axial shaft member and rollingly engaging said eccentrically disposed interior surface of said casing member.

11. The distributor roller according to claim 7, wherein said at least one engagement surface provided on said oscillating body member for engaging said eccentrically disposed interior surface of said casing member comprises at least two roller bearing members rotatably mounted on said oscillating body member about axes substantially parallel to the longitudinal axis of said axial shaft member and rollingly engaging said eccentrically disposed interior surface of said casing member, said two roller bearing members being diametrically opposed to one another on opposite transverse sides of said axial shaft member.

12. The distributor roller according to claim 1, wherein the cross-section of said interior surface of said casing member, when taken substantially transverse to said axial shaft member, is substantially circular.

13. The distributor roller according to claim 11, wherein the cross-section of said interior surface of said casing member, when taken substantially transverse to said axial shaft member, is substantially circular.

14. The distributor roller according to claim 7, wherein said means for rotating said casing member comprises a driven roller member disposed adjacent to and engaging said distributor roller.

15. The distributor roller according to claim 13, wherein said means for rotating said casing member comprises a driven roller member disposed adjacent to and engaging said distributor roller.

16. The distributor roller according to claim 8, said distributor roller additionally comprising at least one rotational bearing fixedly attached to said casing member and rotationally mounted about said axial shaft member, said at least one rotational bearing having an annular sleeve, a surface of said annular sleeve forming said eccentrically disposed interior surface of said casing member.

17. The distributor roller according to claim 15, said distributor roller additionally comprising at least one rotational bearing fixedly attached to said casing member and rotationally mounted about said axial shaft member, said at least one rotational bearing having an annular sleeve, a surface of said annular sleeve forming said eccentrically disposed interior surface of said casing member.

18. The distributor roller according to claim 17, said distributor roller additionally comprising a bearing body member non-rotatably attached to said axial shaft member and having a bearing pin extending therefrom and disposed substantially parallel to the longitudinal axis of said axial shaft member, said oscillating body member being pivotally mounted on said connecting pin member for pendulum-like movement thereabout in the direction substantially transverse to the longitudinal axis of the axial shaft member.

19. The distributor roller according to claim 18, wherein said cam member is maintained against any substantial axial displacement with respect to said axial shaft member.

20. The distributor roller according to claim 19, wherein said rotary body member is maintained against any substantial axial displacement with respect to said axial shaft member.

* * * * *